US008531445B2

(12) United States Patent
Kim

(10) Patent No.: US 8,531,445 B2
(45) Date of Patent: Sep. 10, 2013

(54) DEVICE FOR CONTROLLING THE GATE DRIVE VOLTAGE IN LIQUID CRYSTAL DISPLAY AND INFLUENCING THE TURN-ON VOLTAGE TO HAVE A SIMILAR RIPPLE TO A TURN-OFF VOLTAGE

(75) Inventor: Hyungkyu Kim, Beijing (CN)

(73) Assignee: Beijing Boe Optoelectronics Technology Co., Ltd., Beijing (CN)

( * ) Notice: Subject to any disclaimer, the term of this patent is extended or adjusted under 35 U.S.C. 154(b) by 264 days.

(21) Appl. No.: 12/722,154

(22) Filed: Mar. 11, 2010

(65) Prior Publication Data

US 2010/0231572 A1 Sep. 16, 2010

(30) Foreign Application Priority Data

Mar. 12, 2009 (CN) ..... 2009 1 0079907

(51) Int. Cl.
*G09G 5/00* (2006.01)

(52) U.S. Cl.
USPC ..... 345/211; 345/87

(58) Field of Classification Search
USPC 345/211–213, 87, 98, 100; 315/169.1–169.4
See application file for complete search history.

(56) References Cited

U.S. PATENT DOCUMENTS

| | | | | |
|---|---|---|---|---|
| 5,831,605 | A * | 11/1998 | Yasui et al. | 345/211 |
| 2008/0030494 | A1 | 2/2008 | Woo et al. | |
| 2009/0122213 | A1 * | 5/2009 | Ko et al. | 349/46 |

FOREIGN PATENT DOCUMENTS

| | | | |
|---|---|---|---|
| CN | 101197566 | A | 6/2008 |
| KR | 10-0620139 | B1 | 9/2006 |
| KR | 100620139 | * | 9/2006 |
| KR | 100620139 | B1 | 9/2006 |

* cited by examiner

*Primary Examiner* — Chanh Nguyen
*Assistant Examiner* — Ram Mistry
(74) *Attorney, Agent, or Firm* — Ladas & Parry LLP

(57) ABSTRACT

A device for controlling the gate drive voltage in the liquid crystal display is provided in the invention. The device for controlling the gate drive voltage in the liquid crystal display according to the invention includes a turn-on voltage output terminal and a turn-off voltage output terminal for outputting a turn-on voltage and a turn-off voltage to a gate drive circuit, respectively, and a control circuit. The control circuit is coupled with the turn-on voltage output terminal and exerts an influence on the turn-on voltage so that the turn-on voltage has a ripple similar to that of the turn-off voltage.

9 Claims, 4 Drawing Sheets

DEVICE FOR CONTROLLING THE GATE DRIVE VOLTAGE IN LIQUID CRYSTAL DISPLAY AND INFLUENCING THE TURN-ON VOLTAGE TO HAVE A SIMILAR RIPPLE TO A TURN-OFF VOLTAGE

BACKGROUND

The present invention relates to a device for controlling the gate drive voltage in a liquid crystal display.

A liquid crystal display comprises a liquid crystal panel and a backlight module. The backlight module provides planar light to the liquid crystal panel. The liquid crystal panel comprises an array substrate, a color filter substrate and a liquid crystal layer, and the liquid crystal layer is formed through injecting liquid crystal into the space between the array substrate and the color filter substrate that face each other.

The array substrate comprises a plurality of pixel units, and each of the pixel units may be formed with a plurality of gate lines, a plurality of data lines, a plurality of thin film transistors (TFTs), a plurality of pixel electrodes, a plurality of common electrode lines and the like. The gate lines, the data lines, and the common electrode lines can be collectively referred to as the signal lines. For example, the gate lines and the common electrodes line are laterally provided on the array substrate, the data lines are longitudinally provided on the array substrate, and the TFTs are provided at the intersections of the gate lines and the data lines. The TFTs are active switching elements and each may be formed with a gate electrode, a gate insulating layer, an active layer, a TFT channel, a source electrode, a drain electrode, a passivation layer and the like. The gate electrode is connected or integrally formed with one of the gate lines, the source electrode is connected or integrally formed with one of the data lines, and the drain electrode is normally connected with one of the pixel electrodes through a passivation layer via hole. When a turn-on ("ON") voltage is input into one of the gate lines, the active layer of the TFT that is connected with the gate line becomes conductive, and the data signal over the data line connected with the TFT travels, through the TFT channel region, from the source electrode to the drain electrode, and ultimately into the pixel electrode. After receiving the signal input, the pixel electrode, together with a common electrode provided on the color filter substrate, forms an electric field to drive the liquid crystal to rotate.

The drive devices for driving the liquid crystal display include a BLU controller, a timing controller, a gate drive circuit, a data driver and the like.

Liquid crystal displays tend to have a thinner appearance and a lower manufacturing cost in recent years. With the development of liquid crystal displays, there emerges a liquid crystal display without an individual gate drive print circuit board (referred to as GATE PCB-less LCD). In a GATE PCB-less LCD, signals originally transmitted by the gate drive integrated circuit board are transmitted by circuits that are directly formed on the glass substrate used to form the array substrate, that is, the gate drive circuits are formed on the array substrate, and thus it is not necessary to form the individual gate drive integrated circuit board. The liquid crystal display, therefore, has a reduced thickness and a lowered manufacturing cost.

In the GATE PCB-less LCD, a source drive circuit board is used to output the turn-off ("OFF") voltage (referred to as $V_{off}$) and the turn-on voltage (referred to as $V_{on}$), which are used to drive the gate lines, to the gate drive circuits, and to output the common voltage (referred to as $V_{com}$) used by the common electrode lines. Because of the resistance of the wirings on the array substrate that connect the source drive circuit board with the gate drive circuits, there exists a variation of $V_{off}$ among the gate drive circuits (one gate drive circuit is used to transmit signal to one gate line) and a variation of $V_{com}$ among the common electrode lines. In addition, for each pixel unit, in the case that parasitic capacitance is formed between the data line and the common electrode line on the array substrate and parasitic capacitance is formed between the gate line and the data line, a ripple of $V_{com}$ and a ripple of $V_{off}$ occur due to the influence of the data signal, and the magnitude and the waveform of the ripples of $V_{com}$ and $V_{off}$ are similar. The variation and ripple of $V_{com}$ and $V_{off}$ are especially significant between the first gate drive circuit and the second gate drive circuit, because the amount of the current flowing through the first gate drive circuit and the second gate drive circuit is the largest and thereby the voltage drop is also the largest. In contrast, $V_{on}$, of the gate lines are almost not subject to the aforementioned variation and ripple, due to its short duration, and thus $V_{on}$ at one gate drive circuit is almost the same as that at another gate drive circuit, i.e., $V_{on}$ is relatively uniform among the gate drive circuits.

FIG. 1 is a waveform diagram showing $V_{off}$ in a conventional GATE PCB-less LCD.

The solid lines a and a' in FIG. 1 are $V_{off}$ of the first gate drive circuit, and the dashed lines b and b' are $V_{off}$ of the second gate drive circuit. The lines a and b represent the waveforms of $V_{off}$ under positive data signal (Positive DATA), and the lines a' and b' represent the waveforms of $V_{off}$ under negative data signal (Negative DATA). As shown in FIG. 1, in the GATE PCB-less LCD, the variation and ripple of $V_{off}$ become more significant with the gate drive circuit of a bigger serial number.

Since $V_{on}$ is relatively uniform among the gate drive circuits and $V_{off}$ is subject to the above variation and ripple, the difference of the $V_{on}$ and $V_{off}$ at one gate drive circuit differs from that at another gate drive circuit. The difference of $V_{on}$ and $V_{off}$ is referred to as $\Delta V_g$, which is an important factor influencing the charging characteristic of a pixel electrode.

FIG. 2 is a diagram showing the variation of $\Delta V_g$ between the first gate drive circuit and the second gate drive circuit. In FIG. 2, line a represents the waveform of the $V_{off}$ at the first gate drive circuit, line b represents the waveform of $V_{off}$ at the second gate drive circuit, and line d represents the waveform of $V_{on}$ at the first and second gate drive circuits; $\Delta V_{g-1}$ represents $\Delta V_g$ at the first gate drive circuit; and $\Delta V_{g-2}$ represents $\Delta V_g$ at the second gate drive circuit. As sown in FIG. 2, $\Delta V_{g-1}$ is larger than $\Delta V_{g-2}$, that is, $\Delta V_{g-1}$ and $\Delta V_{g-2}$ differ from each other. Because of the variation of $\Delta V_g$, the ripple of the charging amount (referred to as $\Delta V_p$) of a pixel electrode varies among different gate line circuits. $\Delta V_p$ is caused by the parasitic capacitance formed by the pixel electrode and the gate line. When the gate line switches between $V_{off}$ and $V_{on}$, the ripple of the charging amount is generated due to the parasitic capacitance.

The relationship between $\Delta V_p$ and $\Delta V_g$ is expressed as follows:

$$\Delta V_p = C_{gd} * \Delta V_g / C_{tot} \quad (1)$$

$$C_{tot} = C_{gd} + C_{1c} + C_s \quad (2),$$

where $C_{gd}$ is the parasitic capacitance between the gate line and the drain electrode, $C_{1c}$ stands for the liquid crystal capacitance, and $C_s$ is the storage capacitance in parallel with the liquid crystal capacitance. Since $C_{gd}$, $C_{1c}$, and C, are constants, $\Delta V_p$ is proportional to $\Delta V_g$.

The variation of $\Delta V_p$ among the pixel electrodes corresponding to the gate drive circuits causes an abnormal block image in the lateral direction (also referred to as Y-Block phenomenon). The so-called Y-Block phenomenon is referred to the phenomenon that a variation of the gray level occurs among the driving regions of the gate drive circuits. The Y-Block phenomenon occurs when there exists a variation of $\Delta V_g$ among the gate drive circuits but does not occur when there is no variation of $\Delta V_g$. The Y-block phenomenon is an important factor that reduces the display quality of the liquid crystal display. The Y-Block phenomenon occurs when the variation of $\Delta V_g$ exists, irrespective of the polarities of the data signals.

SUMMARY

A device for controlling the gate drive voltage in the liquid crystal display is provided in an embodiment of the invention. The device for controlling the gate drive voltage in the liquid crystal display includes a turn-on voltage output terminal and a turn-off voltage output terminal for outputting a turn-on voltage and a turn-off voltage to a gate drive circuit, respectively, and a control circuit. The control circuit is coupled with the turn-on voltage output terminal and exerts an influence on the turn-on voltage, so that the turn-on voltage has a ripple similar to that of the turn-off voltage.

A liquid crystal display is provided in another embodiment of the invention. The liquid crystal display includes the above-described device for controlling the gate drive voltage.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the following detailed description.

BRIEF DESCRIPTION OF THE DRAWINGS

The present invention will become more fully understood from the detailed description given hereinafter and the accompanying drawings which are given by way of illustration only, and thus are not limitative of the present invention and wherein.

DESCRIPTION OF THE EMBODIMENTS

The device for controlling the gate drive voltage in the liquid crystal display according to the embodiments of the invention can apply to a thin film transistor liquid crystal display (TFT-LCD) such as a GATE PCB-less LCD. The device includes a turn-on voltage output terminal, a turn-off voltage output terminal, a common voltage output terminal, and a control circuit. Through employing the control circuit, the $V_{on}$ of the turn-on voltage output terminal is rendered under the influence of the ripple of $V_{com}$ of the common voltage output terminal or the ripple of $V_{off}$ of the turn-off voltage output terminal. For example, the control circuit may be disposed between the turn-on voltage output terminal and the turn-off voltage output terminal so as to couple them together, which renders the ripple of $V_{on}$ similar to that of $V_{off}$. If $V_{com}$ and $V_{off}$ have similar ripples, the control circuit may be provided between the turn-on voltage output terminal and the common voltage output terminal so as to couple them together, and thus $V_{on}$ is rendered under the influence of the ripple of $V_{com}$ and thus the ripple of $V_{on}$ is rendered similar to that of $V_{off}$. In this way, $\Delta V_g$ (the difference between the $V_{on}$ and the $V_{off}$) does not substantially vary with the ripple of $V_{off}$ and can be kept relatively uniform among the gate drive circuits on the array substrate of the liquid crystal display, and accordingly the ripple of the charging amount $\Delta V_E$, of the pixel electrode becomes relatively uniform among the gate drive circuits. Therefore, the Y-Block phenomenon occurring among the gate drive circuit regions can substantially reduced.

Hereinafter, the embodiments of the invention will be described in detail with reference to the drawings.

Figure 1:
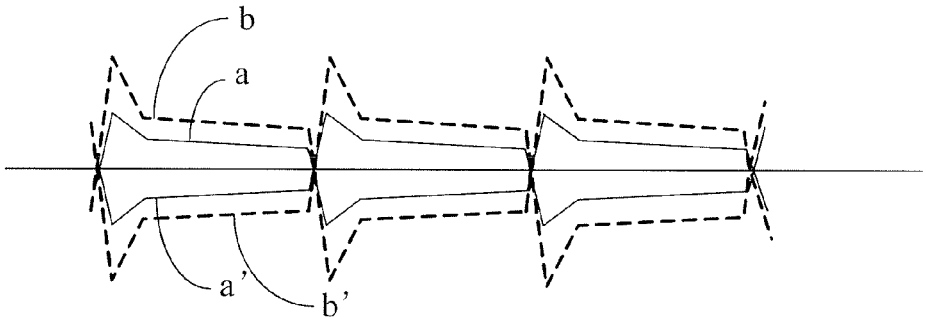
FIG. 1 is a waveform diagram showing the $V^{off}$ in a conventional GATE PCB-less LCD.
Figure 2:
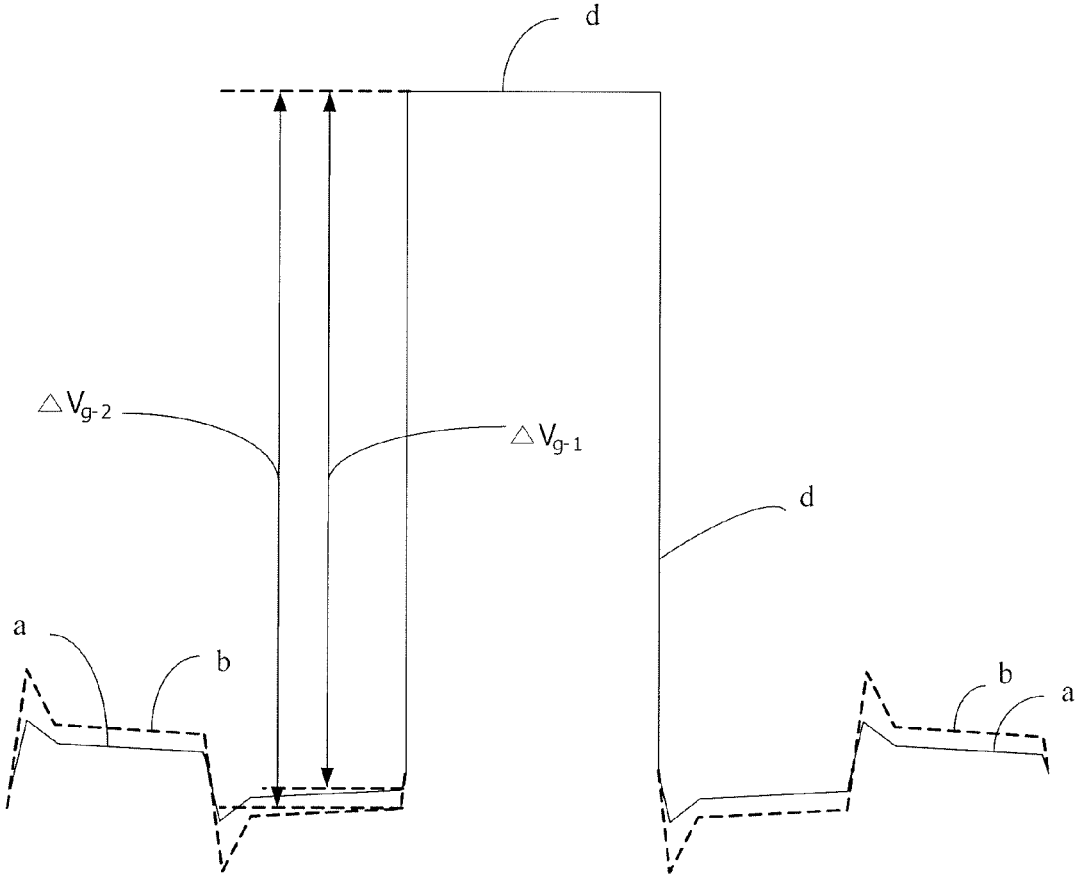
FIG. 2 is a diagram showing the variation of the $\Delta V_g$ between the first gate drive circuit and the second gate drive circuit.
Figure 3:
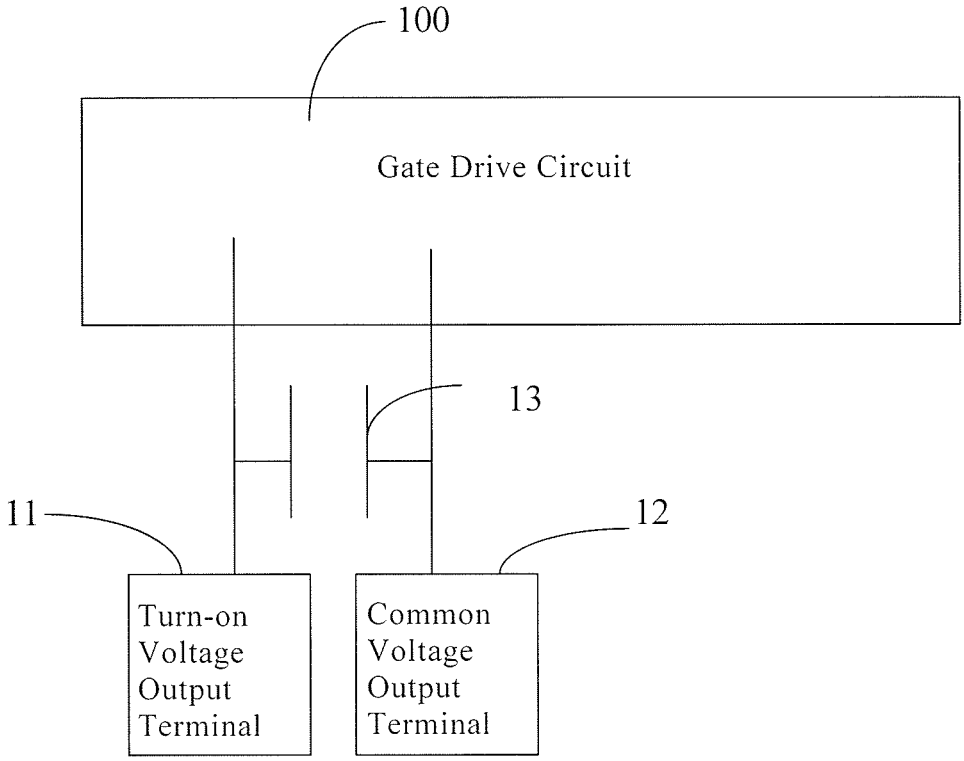
FIG. 3 is a schematic view showing a device for controlling the gate drive voltage in the liquid crystal display according to a first embodiment of the invention.

FIG. 3 is a diagram showing the structure of a device for controlling the gate drive voltage in the liquid crystal display according to a first embodiment of the invention. As shown in FIG. 3, the device for controlling the gate drive voltage in the liquid crystal according to this embodiment includes a turn-on voltage output terminal 11, a common voltage output terminal 12, and a control circuit 13. The control circuit in this embodiment is a capacitor 13, for example. The turn-on voltage output terminal 11 and the common voltage output terminal 12 are coupled with each other through the capacitor 13. Specifically, one end of the capacitor 13 is connected with both the turn-on voltage output terminal 11 and a gate drive circuit 100, and the other end of the capacitor 13 is connected with both the common voltage output terminal 12 and the gate drive circuit 100. In this embodiment, parasitic capacitance is formed between the data line on the array substrate and the common electrode and parasitic capacitance is formed between the gate line and the data line. Therefore, $V_{com}$ and $V_{off}$ have ripples with similar magnitudes and waveforms. The common voltage output terminal 12 is used to provide a common voltage for a liquid crystal display panel, and in this embodiment, the common voltage output terminal 12 provides the common voltage for a liquid display panel via the gate drive circuit 100, but in another embodiment, the common voltage output terminal 12 may directly provide the common voltage for a liquid display panel without the help of the gate drive circuit 100.

In this way, $V_{com}$ of the common voltage output terminal 12 is used as the reference voltage of $V_{on}$ of the turn-on voltage output terminal 11, so that a linkage between $V_{com}$ and $V_{on}$ is established. Thus, $V_{com}$ is under the influence of the ripple of $V_{com}$, so that $V_{on}$ has a ripple similar to that of $V_{com}$. At this time, since $V_{com}$ and $V_{off}$ have similar ripples, $V_{on}$ and the $V_{off}$ also have similar ripples. Therefore, the difference $\Delta V_g$ between $V_{on}$ and $V_{off}$ can be kept relatively uniform among the drive circuits on the array substrate of the liquid crystal display, which reduces the Y-Block phenomenon.

Figure 4:
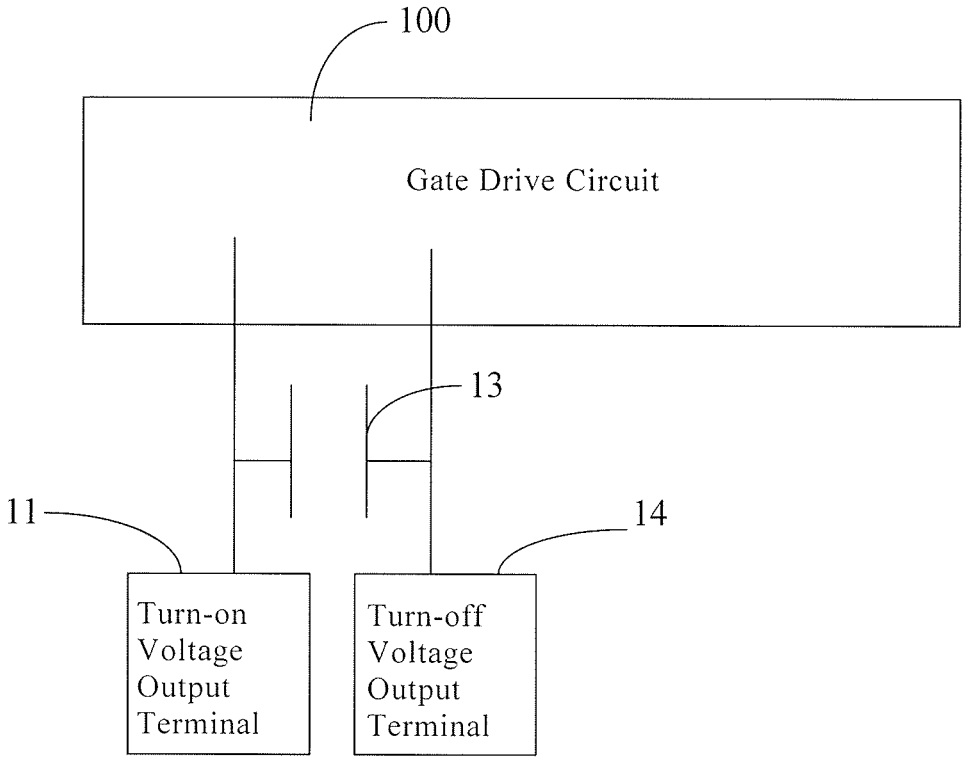
FIG. 4 is a schematic view showing a device for controlling the gate drive voltage in the liquid crystal display according to a second embodiment of the invention.

FIG. 4 is a diagram showing the structure of a device for controlling the gate drive voltage in the liquid crystal display according to a second embodiment of the invention. As shown in FIG. 4, the device for controlling the gate drive voltage in the liquid crystal according to this embodiment includes a turn-on voltage output terminal 11, a turn-off voltage output terminal 14, and a capacitor 13. The turn-on voltage output terminal 11 is coupled with the turn-off voltage output terminal 14 through the capacitor 13. Specifically, one end of the capacitor 13 is connected with both the turn-on voltage output terminal 11 and a gate drive circuit 100, and the other end of the capacitor 13 is connected with both the turn-off voltage output terminal 14 and the gate drive circuit 100.

In this way, $V_{off}$ of the turn-off voltage output terminal 14 is used as the reference voltage of $V_{on}$ of the turn-on voltage output terminal 11, so that a linkage between the $V_{off}$ and the $V_{on}$ is established. Thus, $V_{on}$ is under the influence of the ripple of $V_{off}$, so that $V_{on}$ has a ripple similar to that of the $V_{off}$. Therefore, the difference $\Delta V_g$ between the $V_{on}$ and the $V_{off}$ can be kept relatively uniform among the gate drive circuits, which reduces the Y-Block phenomenon.

Figure 5:
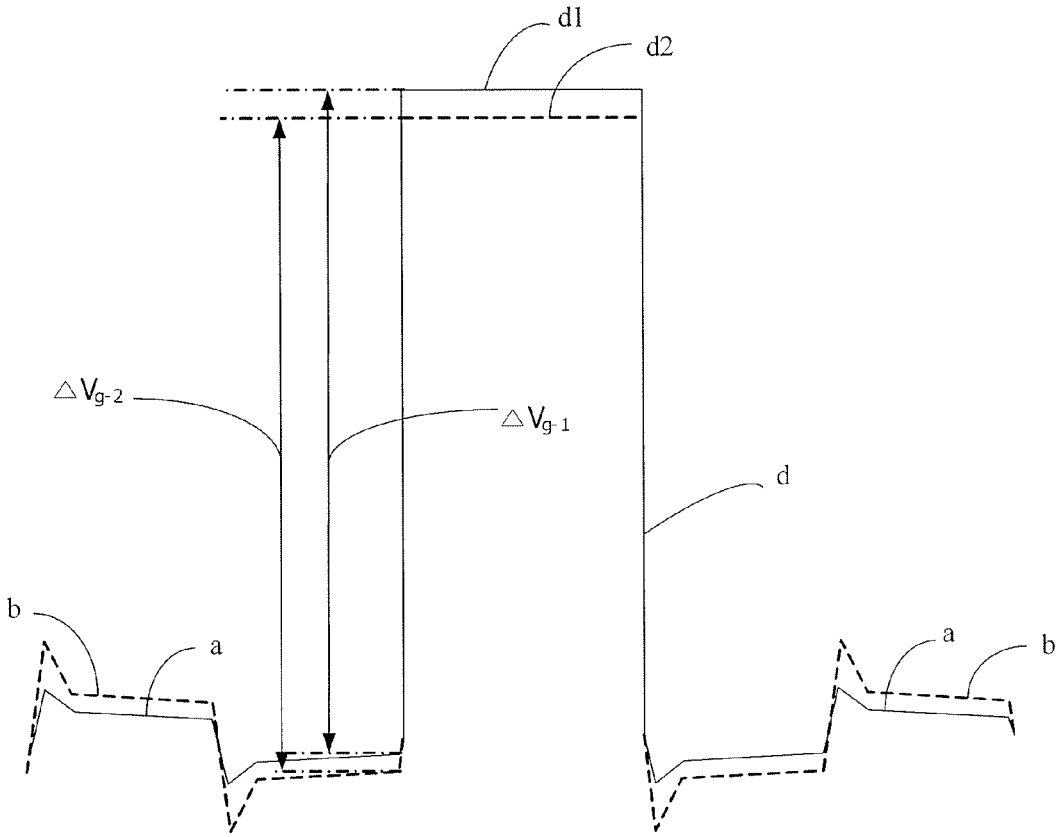
FIG. 5 is a waveform diagram showing the voltages when the device for controlling the gate drive voltage according to the first and second embodiments is employed in the liquid crystal display.

FIG. 5 is a waveform diagram showing the voltages when the device for controlling the gate drive voltage according to the first or second embodiments is employed in the liquid crystal display. In FIG. 5, line a represents $V_{off}$ of the first gate drive circuit, line b represents $V_{off}$ of the second gate drive circuit, line d1 represents $V_{on}$ of the first gate drive circuit, line d2 represents $V_{on}$ of the second gate drive circuit, $\Delta V_{g-1}'$ is $\Delta V_g$ of the first gate drive circuit, and $\Delta V_{g-2}'$ is $\Delta V_g$ of the second gate drive circuit. As shown in FIG. 5, because of the control circuit such as the capacitor, $V_{on}$ is under the influence of the ripple of $V_{off}$ or $V_{com}$ so that $\Delta V_{g-1}'$ and $V_{g-2}'$ are similar to each other. Therefore, a significant variation of $\Delta V_g$ among the gate drive circuits will not be caused and the Y-Block phenomenon can be reduced.

It should be understood by those skilled in the art that although a simple circuit element such as the capacitor is used to realize the embodiments of the invention, the embodiments of the invention can employ various circuits such as a RC circuit, by which the turn-on voltage can be influenced by the ripple of the common voltage or the turn-off voltage so that the turn-on voltage has a ripple similar to that of the common voltage or the turn-off voltage and $\Delta V_g$ variation among the gate drive circuits can be eliminated.

A liquid crystal display is provided in another embodiment of the invention. The liquid crystal display includes the device for controlling the gate drive voltage, for example, shown in FIG. 3 or FIG. 4. The liquid crystal display is a TFT-LCD.

It should be appreciated that the embodiments described above are intended to illustrate but not limit the present invention. Although the present invention has been described in detail herein with reference to the preferred embodiments, it should be understood by those skilled in the art that the present invention can be modified and some of the technical features can be equivalently substituted without departing from the spirit and scope of the present invention.

What is claimed is:

1. A device for controlling the gate drive voltage in a liquid crystal display, comprising:

a turn-on voltage output terminal and a turn-off voltage output terminal for outputting, respectively, a turn-on voltage and a turn-off voltage to a gate drive circuit; and a control circuit, wherein the control circuit is coupled with the turn-on voltage output terminal and exerts an influence on the turn-on voltage so that the turn-on voltage has a ripple similar to that of the turn-off voltage;

wherein the control circuit is provided between the turn-on voltage output terminal and the turn-off voltage output terminal to couple them together, one end of the control circuit is directly electrically connected with both the turn-on voltage output terminal and the gate drive circuit, and the other end of the control circuit is directly electrically connected with both the turn-off voltage output terminal and the gate drive circuit.

2. The device for controlling the gate drive voltage in a liquid crystal display according to claim 1, wherein the control circuit comprises a capacitor.

3. The device for controlling the gate drive voltage in a liquid crystal display according to claim 1, wherein the control circuit is a RC circuit.

4. A device for controlling the gate drive voltage in a liquid crystal display, comprising:

a turn-on voltage output terminal and a turn-off voltage output terminal for outputting, respectively, a turn-on voltage and a turn-off voltage to a gate drive circuit;

a control circuit, wherein the control circuit is coupled with the turn-on voltage output terminal and exerts an influence on the turn-on voltage so that the turn-on voltage has a ripple similar to that of the turn-off voltage; and a common voltage output terminal for outputting a common voltage, wherein the common voltage has a ripple similar to that of the turn-off voltage during entire operation of the device;

wherein the control circuit is provided between the turn-on voltage output terminal and the common voltage output terminal to couple them together, one end of the control circuit is directly connected with both the turn-on voltage output terminal and the gate drive circuit, and the other end of the control circuit is directly connected with both the common voltage output terminal and the gate drive circuit.

5. The device for controlling the gate drive voltage in a liquid crystal display according to claim 4, wherein the control circuit comprises a capacitor.

6. The device for controlling the gate drive voltage in a liquid crystal display according to claim 4, wherein the control circuit is a RC circuit.

7. A liquid crystal display including a device for controlling the gate drive voltage comprising:

a turn-on voltage output terminal and a turn-off voltage output terminal for outputting, respectively, a turn-on voltage and a turn-off voltage to a gate drive circuit; and a control circuit, wherein the control circuit is coupled with the turn-on voltage output terminal and exerts an influence on the turn-on voltage so that the turn-on voltage has a ripple similar to that of the turn-off voltage;

wherein the control circuit is provided between the turn-on voltage output terminal and the turn-off voltage output terminal to couple them together, one end of the control circuit is directly electrically connected with both the turn-on voltage output terminal and the gate drive circuit, and the other end of the control circuit is directly electrically connected with both the turn-off voltage output terminal and the gate drive circuit.

8. The liquid crystal display according to claim 7, wherein the control circuit comprises a capacitor.

9. The liquid crystal display according to claim 7, wherein the control circuit is a RC circuit.

* * * * *